United States Patent [19]

Le Vantine

[11] Patent Number: 4,635,161

[45] Date of Patent: Jan. 6, 1987

[54] DEVICE FOR REMOVING STATIC CHARGE, DUST AND LINT FROM SURFACES

[76] Inventor: Allan D. Le Vantine, 18225 Rancho St., Tarzana, Calif. 91356

[21] Appl. No.: 794,773

[22] Filed: Nov. 4, 1985

[51] Int. Cl.[4] ..... H05F 3/06

[52] U.S. Cl. ..... 361/213

[58] Field of Search ..... 361/212, 213, 214, 220, 361/229, 230, 231

[56] References Cited

U.S. PATENT DOCUMENTS

| | | | |
|---|---|---|---|
| 3,308,343 | 3/1967 | Smith et al. | 361/213 |
| 4,194,232 | 3/1980 | Cumming et al. | 361/213 |
| 4,213,167 | 7/1980 | Cumming et al. | 361/213 |
| 4,333,123 | 6/1982 | Mouiden | 361/213 |
| 4,498,116 | 2/1985 | Saurenman | 361/213 |
| 4,502,091 | 2/1985 | Saurenman | 361/213 |
| 4,528,612 | 7/1985 | Spengler | 361/213 |

*Primary Examiner*—L. T. Hix
*Assistant Examiner*—Douglas S. Lee

[57] ABSTRACT

A device for eliminating static charge, dust and lint from surfaces by forced convection of electrically ionized air or gas. The device utilizes high voltage direct current and forced convection sources to ionize the air or gas into separate positive and negative flows which are joined into concentric interlaced helical streams in a rotating vortex forming chamber. The rotating streams exit the device into the adjacent atmosphere, whereupon coming in contact with a statically charged surface, they cause the neutralization of the static charge by the alternate passage of the streams of positive and negative ionized air or gas over that surface. The device may also incorporate high velocity jets to additionally convect away dust and lint adhering to a surface.

10 Claims, 9 Drawing Figures

FIG. 1
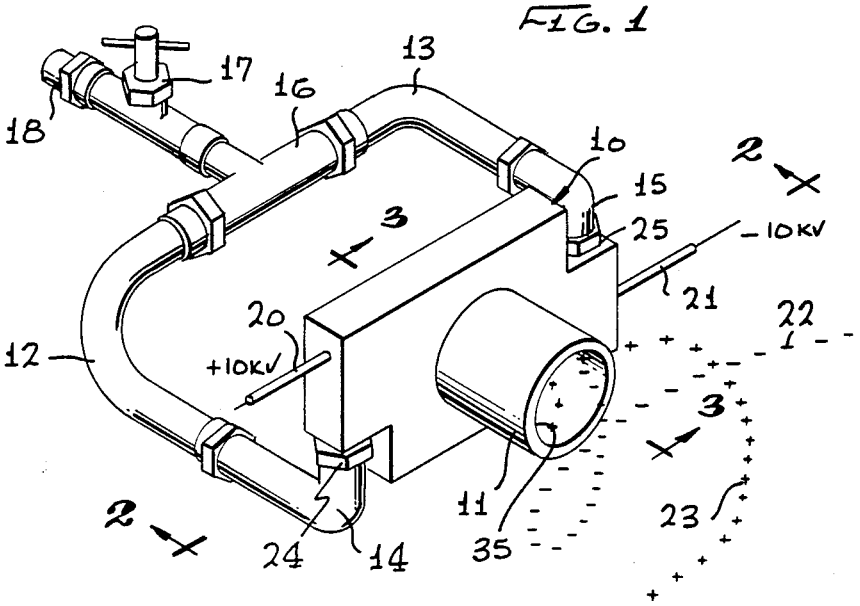
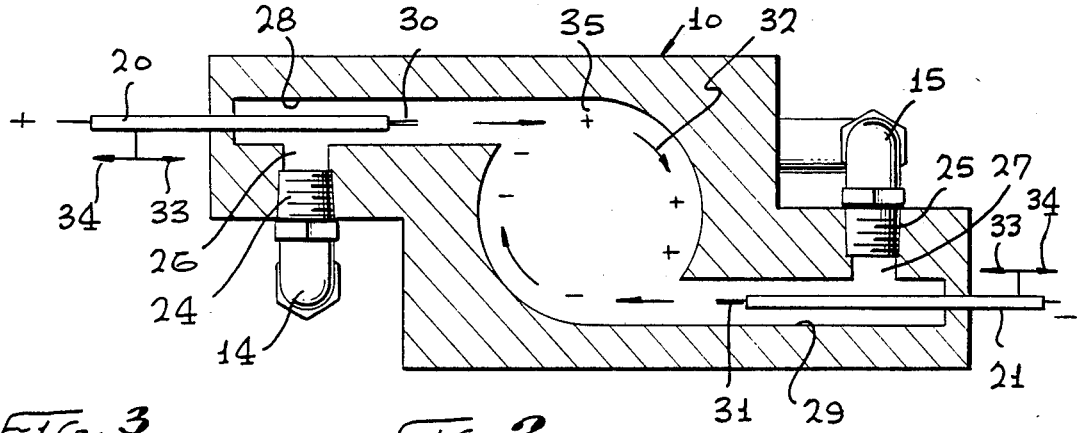
FIG. 3
FIG. 2
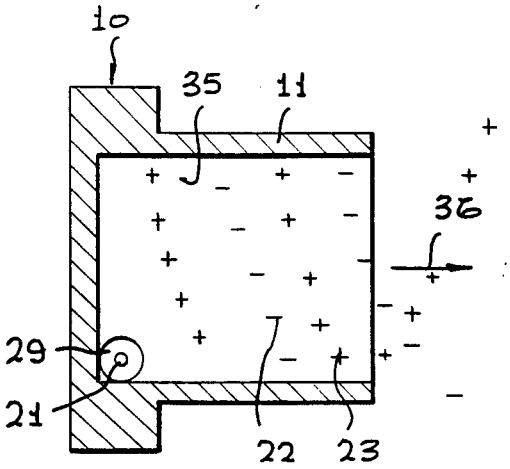
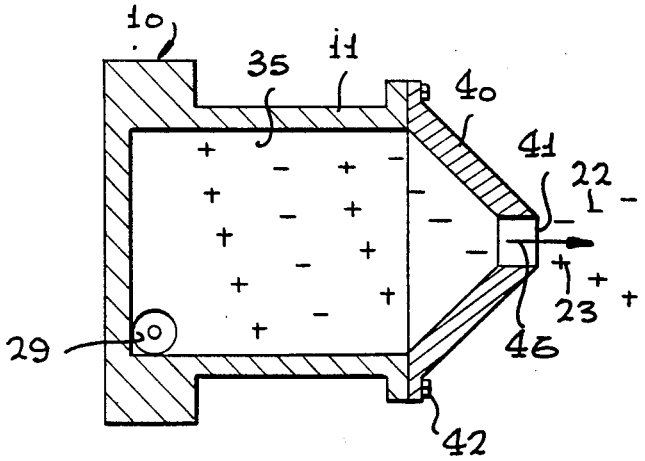
FIG. 4

FIG. 5
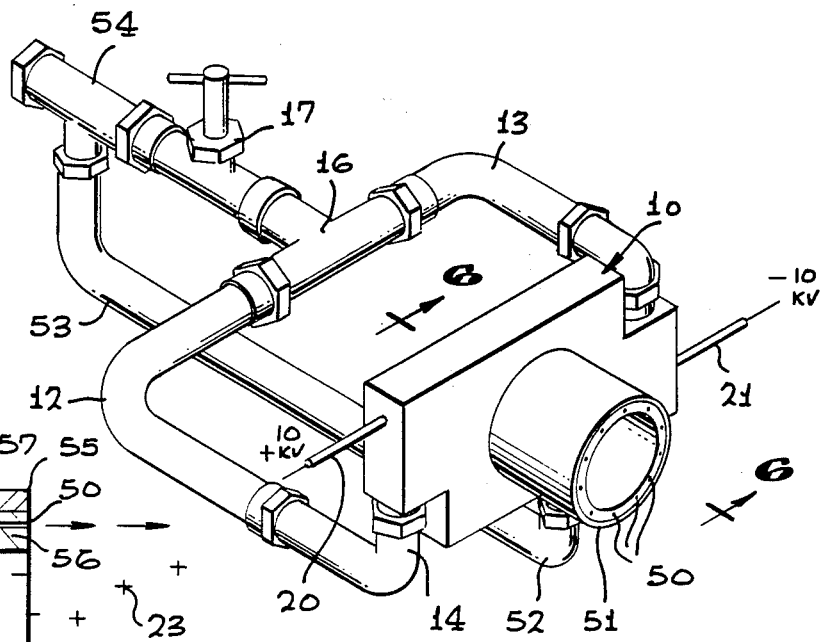
FIG. 6
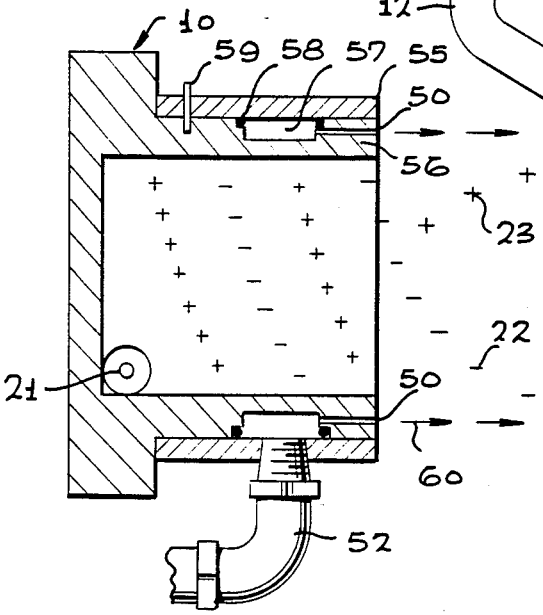
FIG. 8
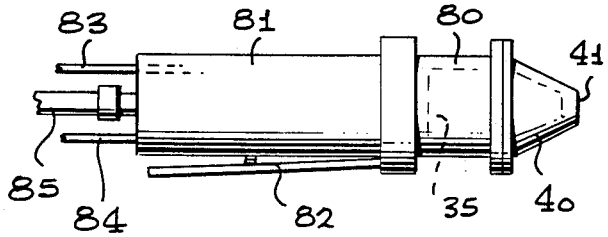
FIG. 7
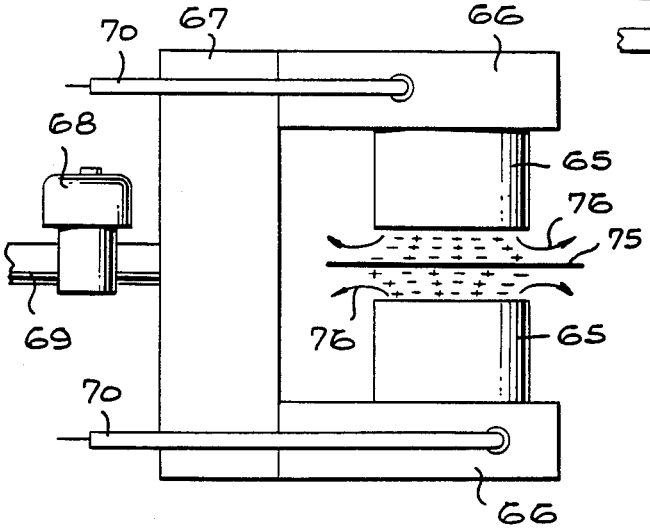
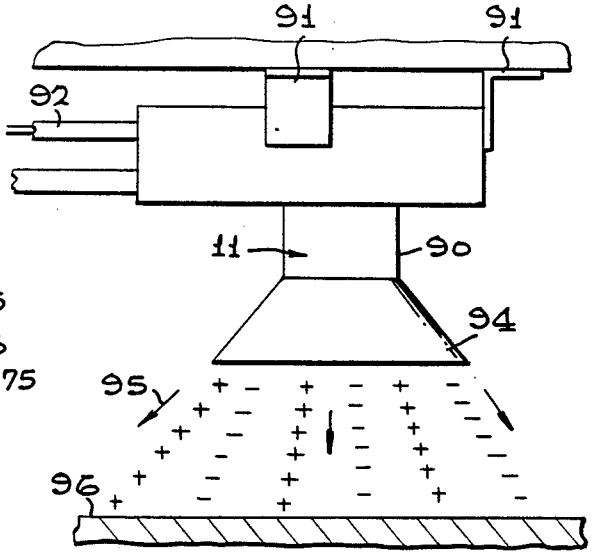
FIG. 9

DEVICE FOR REMOVING STATIC CHARGE, DUST AND LINT FROM SURFACES

BACKGROUND OF THE INVENTION

1. Field of the Invention

This invention relates to the removal of static charge, dust and lint simultaneously. In many industries the elimination of the static charge which accumulates on electrically non-conductive surfaces is of utmost importance. The static charge attracts and binds dust and lint particles to these surfaces and is counter-productive to the processes of the particular industry. The buildup of static charge in capacitative bodies can also precipitate detrimental effects in many commercial areas. An example of the former is the photo-processing industry. In this industry, where positive prints are made from photographic negatives, it is necessary to keep the negatives free from dust and lint so that the dust and lint are not imaged on the prints where they appear as spots and marks and make the print unacceptable. An example of the latter is the electronic industry where a static charge build-up can affect and damage sensitive solid state electronic elements and components by destroying transister junctions or altering programmed states.

2. Description of the Prior Art

Over the years several methods have been devised to eliminate these static charges. These include such techniques as vaporizers and atomizers to humidify the air, radio-active material to ionize the air, high voltage emitters to also ionize the air, so called antistatic brushes and wipers that contact the affected surfaces, and conductive sprays and liquids applied directly to the surfaces.

Static charge on a non conductive plastic surface develops usually as the result of contact with another plastic object. Such plastic items in contact have an atomic attractive force that holds them together. This force is electric in nature and is of the variety that holds materials together. Separation of the items results in a rending of some of the negatively charged electrons of the atoms from one of the surfaces by the strong attractive force of the other and the adherance of those electrons to that surface. Thus, the surface that has lost electrons is left with an electric charge to again attract negatively charged electrons, and has thereby acquired a positive charge. And, the surface which has gained a surplus of electrons has thereby acquired a negative charge.

This is the classic example of how static charges develop. However, static charges are known to exist in many ways and on surfaces and bodies that do not fit the above example. Static charges are transferable through conductive means such as in the Van de Graff generator or by accumulation of charge on an electrically isolated body through friction means such as an aircraft or a car by friction contact with the passing air. Charges can also be accumulated from direct contact with high voltage sources or by transmission from a surrounding ionized atmosphere.

Except in a vacuum, static charges tend to dissipate, or leak off, through the conductivity of the surrounding atmosphere. The more conductive the atmosphere, the faster the charge will leak off. In humid weather, the moisture in the air makes the air more conductive than on a dry day when there is little moisture in the air.

Thus, we seldom encounter static charge on a humid day and frequently encounter it on a dry day.

Static charges are transferable. Static charge acquired by our clothing is transferred to our bodies through contact with our clothing which surrounds our body or parts of our body. And, when we approach an object of different potential we experience an electric discharge as electrons arc from our finger to that object. Static charge can also be transferred from our bodies to tools we use or to other items we come in contact with. These items in turn can impart the charge to a sensitive component causing damage.

Static charge can be eliminated by two methods. One is by providing a conductive atmosphere to allow the charge to flow to a body or region of opposite potential. The other is by providing the electrical energy directly to the body or region to neutralize the charge. As this invention utilizes electrical means for eliminating static charge the discussion shall be limited to only such means. Further, the discussion will be confined to consider only standard industrial and laboratory environments.

Consider static charge on a plastic film surface. If the surface is placed in an environment of ionized air, it will acquire an equilibrium with the charge of the air. If the surface is of opposite charge, and the air has sufficient energy, the surface will first be neutralized and then equalize with the charge of the air. If there is not sufficient energy in the air, some charge will remain on the surface. If the surface is of the same charge as the air, the end charge on the surface will be equal in potential to that of the end charge on the air.

However, these examples do not occur in bounded isolated regions, therefore they are continually subject to reactions with the surrounding environment. The initial charge on the air is continually being dissipated to the surrounding environment through contact with the limits of the surrounding environment. The walls or other boundaries of the environment continually absorb and deplete the original charge. Thus, an ionized charge on air rapidly decreases. A film with a surface charge inserted into a chamber where the air had its initial charge, will first equalize with the charge of the air and then lose its charge as the charge on the air dissipates to the chamber walls.

This physical occurance, which can be referenced as the "Bleed Off Technique", provides the basis for an excellent means for eliminating static charges for many applications. However, there are applications where this method is impractical to apply or is not possible to incorporate because of the inclusion of other objectives. One such application, and one which is imposed by the objectives of this invention, is the removal of dust and lint from the surface of film by use of a high velocity air flow simultaneous with the elimination of the static charge, to instantly clean and neutralize a surface passing through the device.

High velocity air passing over a surface is turbulent. Hence, it disrupts the ionized neutralizing air making the bleed off technique ineffective. The results are non-uniform leaving portions with a significant residual charge either that of the original charge on the surface or that of an induced charge transferred to the surface by the ionized air from its initially high potential state. The above results occur whether or not the high velocity air has been ionized with the exception of the application of one specific design technique.

The design exception is the use of alternating fields of positive and negative ionized air. Adjacent fields of opposite polarity quickly neutralize each other, thus the fields must be properly spaced so that they interact with the surface as well as each other before neutralization occurs. In this way the surface is neutralized along with the annihilation of the charges on the air.

Previous art in this technique is used by Cumming et al. U.S. Pat. No. 4,194,232. In this application air is impressed on a film surface through small holes which have needles projecting through their center. The needles are supplied with high voltage from an alternating source and serve to ionize the air passing out of the holes The frequency of the high voltage source is sixty hertz alternating between positive and negative at a potential between 3500 and 5500 volts rms. The design is very effective and has shown that the field spacing produced by the sixty hertz is near optimum for providing field separation for this application. Cumming et al. also use this technique in another design U.S. Pat. No. 4,213,167.

Attempts have been made to reproduce the effects of an alternating high voltage air ionizing technique by using separate constant positive and negative high voltage sources. These techniques incorporate alternately spaced positive and negative air ionizing elements either projecting through the air delivery holes or located to either side of the air delivery holes. One of the inherent difficulties of these designs is to keep the opposite polarity ionizers adequately spaced apart so that arcing between them will not occur. However, even though patents on such designs have been issued, Sourenman U.S. Pat. Nos. 4,498,116 and 4,502,091, and Moulden U.S. Pat. No. 4,333,123, experiments show that these designs do not prove to be effective when directed perpendicular to the plane surface, from which the static charge and dust is to be removed.

The deficiency with these systems is that there is not a proper mixing of regions of positive and regions of negative charged air to bring about the annihilation of the charges while in contact with the surface of the film. This leaves the film with residual or induced charges after it has been passed by the system.

SUMMARY OF THE INVENTION

Accordingly it is an object of this invention to provide an improved device for the simultaneous elimination of static charge, dust and lint from plane surfaces.

It is another object of the invention to provide an improved method for eliminating static charge by application of constant positive and constant negative high voltage air ionizing sources.

It is an object of this invention to provide an improved method for ionizing air or gas to both positive and negative potentials. Hereafter, the use of the word air shall denote air and gas.

It is additionally an object of this invention to provide a design technique that produces a uniform mixing of fields of positive and negative ionized air.

It is also an object of this invention to provide a design technique that combines fields of positive and negative ionized air with jets of high velocity air to impinge on a plane surface such that the ionized fields will react in contact with the surface to neutralize the charge on that surface while the high velocity air convects dust, lint and other particulates from the surface.

The above and other objects of the present invention are achieved according to the following aspects thereof.

The primary element of the ionizing and mixing of air is the creation of a vortex. This is accomplished in one embodiment by providing a manifold means in which the air ionizing means and ionized fields mixing means are incorporated. The manifold means is fashioned from a block of electrically non-conductive material with rectangular dimensions on the order of two by three inches and one half inch thick. Projecting from the center of one surface is a tubular extension about one and a half inches in diameter with a one-eighth inch wall and one inch long. External to the block are two connections for air lines located on opposite sides of the tubular projection each accompanied by a high voltage electrical conductor. Internally the manifold means can be described as two one-quarter inch diameter ducts leading from the air line connections to the tube section and intersecting the tube section tangentially with its inner bore. The intersections are located diametrically opposite each other so that air flowing inward through the ducts will circulate circumferentially around the inside of the tube and produce a vortex within the tubular section.

Air from a compressed air or gas source is supplied to both ducts through a metering valve to limit the flow to a prescribed rate. The flow rate can range upward from one quarter of a cubic foot per minute to twenty cubic feet per minute or more.

The high voltage electrical conductors enter the ducts near the air inlets and terminate in air ionizing emitters prior to the ducts opening to the tube. With the application of proper voltages to the emitters, the air passing by them in the ducts will be ionized. One emitter is connected to a positive voltage source, and the other emitter is connected to a negative voltage source. The range of these sources can be from 3500 to 20,000 volts, however both must be approximately equal and of opposite potential.

The ionizing emitters consist of many fine wires fashioned into a brush-like arrangement, attached to the end of the high voltage conductor. Although prior art of emitters utilizes needles with fine points, it has been found that non-erosive wire of small diameter make more effective and longer lasting emitters. The emitters used in this invention are made from two-thousandth of an inch diameter platinum wire. Each brush contains ten free wire ends.

The ionized air in the vortex formed in the tube resolves into a double helix of alternate spirals of positive ionized air and negative ionized air. These spirals move up and out of the end of the tube where they expand with the rotating vortex. When a planar surface is placed perpendicular to the vortex and spaced beyond the tube a short distance, the air from the vortex is deflected radially across the surface producing rotating rays of alternately positive and negative ionized air.

Interaction between the positive and negative spirals and rays and with the walls of the tube as well as with the planar surface and the surrounding air are continuously occurring. These interactions result in all charges gradually being reduced to zero. Thus, a film being passed across the opening of the tube will experience the interaction of the charges and the gradual reduction to zero, and be left with that zero charge as it exits the area.

In a second embodiment of the invention, the tubular section is augmented by the addition of a nozzle means attached to the air outlet end. The nozzle means can be designed so as to concentrate the outflow of the tube into a jet of air with significantly greater velocity and cohesion than the open end of the tube. The nozzle extends the effectiveness of the neutralizing ability of the device a significant distance beyond the end of the tube, and the increased velocity of the exit air enhances its cleaning capability for dust and lint. Exit nozzles with an opening as small as one-quarter inch in diameter have been found to perform satisfactorally.

In a third embodiment of the invention, the vortex is surrounded by a ring of small air jets. In this embodiment, the air jets are incorporated with the tubular section so that a ring of high velocity air is emitted from the end rim of the tube in a direction axial to the tube. The high velocity jets are comprised of holes on the order of thirty thousandths of an inch in diameter, spaced one-quarter of an inch apart and are supplied with air through ducting separate from that of the ionized vortex. The nature of the vortex within the tube is not affected by the jets. With a planar surface placed a short distance away from and across the end of the tube, the jets provide a scouring action greatly enhancing the cleaning of dust and lint from the surface. The jets of air strike the surface and cohesively adhere to the surface flowing radially outward with significant velocity. The ionized air from the vortex in the center of the tube also flows outward into the air from the jets and is entrained with it. Experiments show that the neutralizing effect for static charges is retained during this entrainment.

It should be recognized that the above embodiments can be used alone or incorporated into specialized devices for specific applications. One such device is a static neutralizing and cleaning air nozzle. Another would be a film cleaning device where two of the embodiments would be mounted opposing each other to clean both sides of a film simultaneously. Another could be an aereating device to permeate a work area with static neutralizing air. These are a few of the immediately recognizeable uses to which this invention can be applied.

BRIEF DESCRIPTION OF THE DRAWINGS

The above embodiments of the invention may be more fully understood from the following detailed description taken together with the accompanying drawings wherein similar reference characters refer to similar elements throughout and in which:

FIG. 1 is a perspective view of one embodiment of the invention.

FIG. 2 is a sectional view of block along line 2—2 of FIG. 1.

FIG. 3 is a sectional view of the block and tube along line 3—3 of FIG. 1.

FIG. 4 is a sectional view similar to FIG. 3 of a second embodiment of the invention in which a nozzle is attached to the end of the tube.

FIG. 5 is a perspective view of a third embodiment of the invention in which the tube is surrounded by a ring of air jets.

FIG. 6 is a sectional view of the block and tube along line 6—6 of FIG. 5.

FIG. 7 is a side view of a film cleaner utilizing two elements of the third embodiment of the invention.

FIG. 8 is a side view of a static neutralizing air nozzle utilizing the second embodiment of the invention.

FIG. 9 is a device for neutralizing static charges in a work area.

DESCRIPTIONS OF PREFERRED EMBODIMENTS AND APPLICATIONS

The embodiments of the invention are envisioned but not limited to those described. It should be recognized that other designs can be used to accomplish the unique principles set forth here. Different techniques for creating the vortex could be used, different designs for the ducting and metering of the air are conceivable, and alternate methods for introducing the ionized air into the vortex can be perceived. Moreover, the invention is not limited to the applications described.

Referring to the figures, FIGS. 1, 2 and 3 illustrate the first preferred embodiment. It is comprised of block 10 fashioned from electrically non-conductive material and a tube 11 of similar material continuous with the block. Air lines 12 and 13 lead to and enter block 10 through elbow fittings 14 and 15. Air is supplied to the device through air line 18 where it is metered through needle valve 17 and divided by tee 16 to supply the block. High voltage cables 20 and 21 enter block 10 to provide power for the emitters. Cable 20 is supplied with ten thousand volts positive from a direct current positive high voltage source, and cable 21 is supplied with ten thousand volts negative from a direct current negative high voltage source. Air emitted from the interior of tube 11 forms an expanding rotating column containing streams of negative ionized air 22 and positive ionized air 23.

A sectional view of the block 10 along line and in direction 2—2, FIG. 2, shows the manifold means of the ducts and the chamber at the base of the tube where the air is ionized and the vortex is produced. Air from fittings 14 and 15, attached to block 10 by threaded means 24 and 25, is directed into ducts 26 and 27 which connect with ducts 28 and 29. The air is ionized within ducts 28 and 29 as it flows past emitters 30 and 31 supported on the ends of high voltage cables 20 and 21. The air passing through duct 28 is charged by emitters 30 which are connected to a positive high voltage source through cable 20 thus producing positive ionized air. The air passing through duct 29 is charged by emitters 31 which are connected to a negative high voltage source through cable 21 thus producing negative ionized air. As ducts 28 and 29 enter chamber 35 tangentally and diametrically on opposite sides, the air flowing into chamber 35 is caused to flow circularly around the chamber in the direction of arrows 32 with positive ionized air from duct 28 and negative ionized air from duct 29.

The design requirement dictates that the flow rate of positive and negative ions in the two tangential air streams be equal. Although this is initially accounted for by using positive and negative high voltage sources of equal and opposite potential, an additional adjustment is usually necessary to balance out inequalities, from both mechanical and electrical variations that may exist. Such adjusting means is shown in FIG. 2, whereby the degree of ionization in the air reaching the vortex chamber 35 is determined by the location of the emitters 30 and 31 in the ducts 28 and 29. The farther from the chamber the emitter is located, the greater the loss of ions in the air flow due to the loss of charge when the ions contact the walls of the duct, and the less will be the rate at which the ions reach the chamber. Therefore, the adjusting means comprises an axial movement means for the high voltage cables 20 and 21 through the wall of block 10 and into ducts 28 and 29. Movement of a cable in direction 33 places the emitter closer to the chamber and increases the ion flow rate, while movement in the direction 34 places the emitter farther away from the chamber and reduces the ion flow rate.

The sectional view FIG. 3, taken along line and in direction 3—3 of FIG. 1, shows the interior of block 10 and tube 11. The negative charged air 22 from duct 29 and the positive charged air 23 from duct 28 form into spiral helices flowing in direction 36 from chamber 35 out the end of tube 11. The air is forced to move in the direction 36 by reason of the air entering the base of the chamber 35 through ducts 28 and 29 displacing the air at the base of the chamber and forcing the outward movement. Thus, the air is formed into a helical vortex of alternate streams of positive and negative ionized regions as it passes out of the tube.

FIG. 4 is a sectional view similar to FIG. 3 with the addition of a nozzle 40 attached to the open end of tube 11 by screw means 42. This is the second embodiment of the invention. In this embodiment the air is accelerated in both rotation and linear flow 46 as it passes through opening 41 of nozzle 42. Thus, the velocity in direction 46 as the ionized air leaves the nozzle is greater than it would be if the nozzle were not employed. This results in the narrowing of the streams of positive and negative ionized regions exiting the device and the forced convection of these regions to greater distances.

The third embodiment of the invention is shown in FIGS. 5 and 6. In this embodiment a ring of small air jets 50 are located in the end of tube 51 surrounding the opening in the end of the tube. Tube 51 replaces tube 11 of FIG. 1. Tube 51 differs from tube 11 in that tube 51 is comprised of an inner section 56 and an outer section 55. See FIG. 6, a sectional view along the line and direction of 6—6 of FIG. 5. Between the two sections is plenum 57 which is sealed on either end by O-rings 58. Outer section 55 is retained in by pin 59 which prevents it from sliding off the inner section 56 which is continuous with block 10. Inner section 56 also contains a ring of small holes 50 extending from the plenum to the output end of tube 51.

Air from a compressed air source, enters the plenum through elbow fitting 52 which is supplied through air line 53 from tee 54 placed in the air line ahead of metering valve 17. The air flowing into the plenum is distributed to all the jet holes 50 where it is expelled into the atmosphere in the direction 60 surrounding the streams of negative ionized air 22 and positive ionized air 23 emerging from the center of tube 51. The ring of high velocity air from the jets entrains the ionized air combining with it to produce a more effective cleaning action and to extend the effectiveness of the device a significant distance beyond the end of the tube.

FIG. 7 is a side view of a film cleaning device utilizing two elements 65 of the third embodiment of the invention. The manifold blocks 66 of the two elements are mounted on distribution block 67 which receives air from compressor line 69 through control valve 68 and distributes the air in metered amounts to the ionizing means and vortex forming means and directs compressed air to the plenums of the jet rings. High voltage is supplied through cables 70 to the ionizing means.

A film negative 75 placed within the space between the two elements is subjected to both the ionized air and the high velocity air jets which combine and flow outward across the surfaces of the film in the direction of arrows 76. The action of the air both neutralizes the static charge on the film and effectively cleans and removes dust and lint from the surfaces.

FIG. 8 is a side view of an air nozzle utilizing the second embodiment of the invention described earlier and shown in FIG. 4. This device is comprised of the ionizer and vortex generator with nozzle 80, a handle 81 and a valve operating lever 82. High voltage is supplied to the device through cables 83 and 84 and compressed air is provided through air line 85. A valve means to turn the air on and off is located within the handle, not shown, and a metering means to restrict the air flow to a predetermined rate is also located within the handle, also not shown. The device can be manipulated with one hand to direct neutralizing and cleaning air to a desired area or surface.

FIG. 9 shows a static neutralizing device for mounting over a work area. The device utilizes the arrangement of the first embodiment of the invention 90 with overhead mounting means 91. Affixed to the output end of tube 11 is hood means 94. Hood means 94 is conical in shape and serves to spread the air emitted over a broad area and in a predominantly downward direction, indicated by arrows 95, toward work area 96.

While the principles of the invention are thus disclosed and three embodiments and three applications are described in detail, it is not intended that the invention be limited by such. It should be recognized that many modifications will occur to those skilled in the art which underlies the scope of this invention and that the invention cover such modifications and be limited only by the appended claims.

What is claimed is:

1. A static charge eliminating and dust and lint eliminating device comprising:

a housing means for enclosing and containing elements of the device having connection means for gas or air lines and means for the introduction of a positive high voltage cable and a negative high voltage cable and having an opening means for the exit of static and dust and lint eliminating gas or air, a vortex forming means with ducting connecting to a compressed air or gas source and a chamber means within which the vortex is formed and within which positive charged air or gas and negative charged air or gas are formed into separate concentric axially aligned streams that form helices within the vortex and whereby said helices are made to interlace such that the vortex is made up of alternate bands of positive and negative air or gas and having an opening through which the vortex exits the chamber and flows into the adjacent atmosphere, a metering means for reducing the air or gas flow to the vortex forming means, a positive ionizing means for ionizing air or gas located within the vortex forming means, said positive ionizing means being connected by an electrical conductor to a positive high voltage source, a negative ionizing means for ionizing air or gas located within the vortex forming means, said negative ionizing means being connected by an electrical conductor to a negative high voltage source, an adjustment means for varying the degree of ionization of the air or gas entering the vortex forming chamber.

2. The device of claim 1 wherein the housing means is in the form of a solid block of electrically non-conductive material with internal cavities, passages, inlets, exits and support means for the vortex forming means and the ionizing means.

3. The device of claim 1 wherein the vortex forming means is comprised of two ducts and a cylindrical chamber, the chamber having one closed end and one open end, and wherein the two ducts intersect the cylindrical walls of the chamber tangentially adjacent to the closed end at points, in a plane perpendicular to the axis of the chamber, which are diametrically opposite and tangent in the same direction to the radius of the cylinder, and whereby air or gas flowing in the ducts in a direction toward the chamber will enter the chamber and be directed to flow around the internal wall of the chamber and be displaced away from the closed end of the cylindrical chamber and forced to flow toward and out of the open end of the chamber by the entrance of additional air or gas flowing into the chamber from the ducts.

4. The device of claim 1 wherein the vortex forming means is comprised of two ducts and a cylindrical chamber, the chamber having one closed end and one open end, and wherein the two ducts intersect the cylindrical walls of the chamber tangentially adjacent to the closed end of the chamber and inclined at an angle to the axis of the chamber at two points which are diametrically opposite and tangent in the same direction to the radius of the cylinder, and where the angle of inclination conforms to the angle formed by the pitch of the helices of the streams of air or gas in the chamber formed by the entrance of air or gas flowing into the chamber from the ducts, and wherein said helices of air or gas flow around the internal wall and traverse the length of the chamber flowing toward and out the open end.

5. The device of claim 1 wherein the vortex forming means, having a chamber within which the vortex is formed and having an opening through which the vortex exits and flows into the adjacent atmosphere, said opening being comprised of a nozzle means continuous with the chamber means, said nozzle means reducing the diameter of the opening to the atmosphere in an appropriate manner so as to maintain the integrity of the formed vortex and to cause an increase in the velocity of the air or gas exiting to the surrounding atmosphere.

6. The device of claim 1 wherein the metering means is a flow limiting orifice or valve in the air or gas line leading into the ducts of the vortex forming means.

7. The device of claim 1 wherein the positive and the negative ionizing means consists of plurality of fine platinum wires, each less than ten thousandths of an inch in diameter, formed into a brush and metallically bonded to a supporting means which is also an electrical conductor connecting the platinum wire brush to a high voltage source.

8. The device of claim 1 wherein the positive ionizing means is located within one vortex forming duct and the negative ionizing means is located in the diametrically opposite vortex forming duct.

9. The device of claim 1 wherein the adjustment means for varying the degree of ionization of the air or gas is comprised of a movement means for changing the axial location of the emitters within the ducts.

10. A static charge eliminating and dust and lint eliminating device comprising:

a housing means for enclosing and containing elements of the device having connection means for gas or air lines and means for introduction of a positive high voltage cable and a negative high voltage cable and having an opening means for the exit of static eliminating air, and having a multiplicity of small diameter openings for the exit of high velocity dust and lint eliminating air, a vortex forming means with ducting connecting to a compressed air or gas source and a chamber means within which the vortex is formed and within which positive charged air or gas and negative charged air or gas is formed into separate concentric axially aligned streams that form helices within the vortex and whereby said helices are made to interlace such that the vortex is made up of alternate bands of positive and negative air or gas and having an opening through which the vortex exits the chamber and flows into the adjacent atmosphere, a metering means for reducing the air or gas flow to the vortex forming means, a positive ionizing means for ionizing the air or gas located within the vortex forming means, said positive ionizing means being connected by an electrical conductor to a positive high voltage source, a negative ionizing means for ionizing the air or gas located within the vortex forming means, said positive ionizing means being connected by an electrical conductor to a negative high voltage source, an adjustment means for varying the degree of ionization of the air or gas entering the vortex forming chamber, high velocity air or gas delivery means surrounding the opening through which the vortex exits the vortex forming chamber, said high velocity delivery means comprising a multiplicity of small bore holes spaced apart in a circle of a diameter slightly larger than the diameter of vortex forming chamber, said small bore holes being appreciably aligned axially with the axis of the vortex forming chamber, said small bore holes being supplied internally by high pressure air or gas by means of their intersection with an annular plenum surrounding the vortex forming chamber, said plenum being connected by duct means and tube means to a source of high pressure air or gas.

* * * * *